US005632378A

United States Patent [19]

Provost

[11] Patent Number: 5,632,378

[45] Date of Patent: May 27, 1997

[54] PACKAGE FOR PRODUCTS OF ELONGATE SHAPE, AND THE METHOD OF PRODUCING IT

[75] Inventor: Jean-Jacques Provost, Barret, France

[73] Assignee: CMB Flexible, Barbezieux St Hilaire, France

[21] Appl. No.: 495,439

[22] PCT Filed: Nov. 7, 1994

[86] PCT No.: PCT/FR94/01291

§ 371 Date: Sep. 22, 1995

§ 102(e) Date: Sep. 22, 1995

[87] PCT Pub. No.: WO95/13228

PCT Pub. Date: May 18, 1995

[30] Foreign Application Priority Data

Nov. 8, 1993 [FR] France ..... 93 13277

[51] Int. Cl.[6] ..... B65D 83/10

[52] U.S. Cl. ..... 206/460; 206/800; 206/813; 53/214

[58] Field of Search ..... 206/460, 800, 206/813, 274; 58/219, 465

[56] References Cited

U.S. PATENT DOCUMENTS

| | | | |
|---|---|---|---|
| 2,208,229 | 7/1940 | Ranney | 206/813 |
| 2,210,195 | 8/1940 | Baldwin | 206/800 X |
| 2,380,367 | 7/1945 | Ranney | 206/800 X |
| 3,155,235 | 11/1964 | Maich | 206/813 X |
| 3,459,297 | 8/1969 | Templeton et al. | 206/460 X |
| 3,524,583 | 8/1970 | Gregory | 206/813 |
| 3,734,280 | 5/1973 | Amneus et al. | 206/460 X |
| 4,053,049 | 10/1977 | Beavais | 206/460 X |
| 4,546,875 | 10/1985 | Zweber | 206/813 X |
| 5,311,992 | 5/1994 | Weder et al. . | |
| 5,407,072 | 4/1995 | Woeder et al. | 206/423 |

FOREIGN PATENT DOCUMENTS

| | | |
|---|---|---|
| 2030699 | 11/1970 | France . |
| 2836533 | 2/1980 | Germany . |
| 9311980 | 1/1994 | Germany . |

*Primary Examiner*—David T. Fidei

*Attorney, Agent, or Firm*—Sughrue, Mion, Zinn, Macpeak & Seas

[57] ABSTRACT

A package formed by a wrapper wrapped around a plurality of stacked elongate products (2) each of which temporarily adheres by one of its ends (2B) to an end wall (4) of the wrapper (3). The products may be prepackaged products, such as strips of chewing gum or dairy products, biscuits or bars of chocolate, or else chip cards.

9 Claims, 3 Drawing Sheets

PACKAGE FOR PRODUCTS OF ELONGATE SHAPE, AND THE METHOD OF PRODUCING IT

BACKGROUND OF THE INVENTION

The present invention relates to a package for a series of products, of the type comprising a pliant wrapper, especially of elongate general shape, including a folded and sealed sheet.

Known packages of this type are especially intended for prepackaged products which may, for example, be ailments, such as strips of chewing gum, cheese slices, biscuits or bars of chocolate, or else chip cards. The wrapper contains these products and may be constituted by a rolled-up or folded sheet, for example made of paper or of a complex produced, for example, by the association of a plastic film, of paper and of aluminium (or by the combination of two of these); this sheet surrounds and then envelops a stack of the said products in order to form a cylinder held together by adhesively bonding one longitudinal edge of the sheet to the opposite longitudinal edge; the ends of the cylinder are held in position, folded, by sealing, for example by adhesive bonding, in order for one to form the end wall and the other the lid of the wrapper.

In order to open a package, the lid of the wrapper is, for example, torn and unfolded; when a tear strip is provided for this purpose in proximity to the lid over a circumference of the cylinder of the wrapper, this strip is preferably torn and the lid completely and permanently removed.

Such a package is very economical for commonly consumed products and highly advantageous since it allows them to be preserved grouped together in the wrapper and available, at any moment, for dispensing and consumption.

However, as soon as the wrapper of a package of this type has been opened, it can no longer be closed up again in a secure manner and/or it is permanently without a lid; this wrapper therefore runs the risk, at any moment, of allowing the remaining products that it contains to escape, which represents a serious drawback. This is particularly annoying when the package whose wrapper is already opened is left in the pocket of an article of clothing, in a bag or a case, or else in the glove compartment of a vehicle. The remaining products that it contains may then become dispersed with other objects.

SUMMARY OF THE INVENTION

The object of the present invention is to preserve the integrity of the contents of the wrapper of the package after the wrapper has been opened, including after taking out one or more products from the open wrapper, while at the same time preserving the economical and advantageous character of this type of package.

To this end, the subject of the invention is a package of the aforementioned type, characterized in that a means of temporary adhesion of the products to be packaged is interposed between the wrapper and each of the products.

This package may include one or more of the following characteristics:

the means of temporary adhesion relates to a region of the said products that is aligned with a sealed area of the wrapper;

when the pliant wrapper includes two ends, one end open or intended to be closed by a lid, especially one that cannot be closed again after opening, the other end closed by folding and sealing, serving as the end wall for the wrapper, the means of temporary adhesion of the products to be packaged is interposed between the end wall of the wrapper and the adjacent end of each of the products;

the package contains several stacked, especially prepackaged, products of elongate shape;

the means of adhesion is carried by the wrapper;

each of the said products carries a means of temporary adhesion which adheres to the wrapper;

the means of temporary adhesion comprises an adhesive of the pressure-activable cold-setting adhesive type;

the means of temporary adhesion comprises an adhesive of the heat-activable type.

The subject of the invention is also a method of producing a package as defined hereinabove.

In a first embodiment, this method, of the type comprising:

(a) the placing of a stack of the said products on a possibly preformed sheet; and (b) the forming of a wrapper of tubular general shape by folding and sealing, especially by adhesive bonding, the said sheet thus closing up this wrapper at least partially, is characterized in that it includes, before the step (b) of forming the wrapper, a step (c) of depositing a means of temporary adhesion on that face of the said sheet intended to constitute the inside face of the wrapper, and in that, during the sealing step (b), the means of adhesion is activated at the same time as the sealing of the wrapper.

When the formation of the wrapper at step (b) includes a step of sealing, especially by adhesive bonding, the opposite edges of the said sheet closing up the circumference of the wrapper blank, and a step of folding and sealing, especially by adhesive bonding, at least one end of the wrapper blank, closing at least one end wall of the wrapper, preferably, at step (c), the means of temporary adhesion is deposited at least on that part of the inside face intended to constitute the end wall of the wrapper and is activated at the same time as the sealing of the end wall of the wrapper.

In a second embodiment, the method, of the type comprising the production of a wrapper blank of elongate general shape, the filling of the wrapper blank with the said products and the formation of a wrapper of tubular general shape by folding and sealing, especially by adhesive bonding, the said sheet thus closing up this wrapper blank at least partially, is characterized in that it includes a step of coating part of each of the products or of their prepackage, which part is intended to come into contact with the wrapper via a means of temporary adhesion, and in that the means of temporary adhesion is activated at the same time as the sealing of the wrapper.

In this case, when the formation of the wrapper includes a step of folding and sealing, especially by adhesive bonding, at least one end of the wrapper blank, thus closing at least one end wall of the wrapper, preferably, each of the products is coated on one of its ends, or of the ends of its prepackage, facing the end wall, by a means of temporary adhesion and the means of adhesion is activated at the same time as the sealing of the end wall of the wrapper.

The invention will be better understood on reading the following description, given by way of example and with reference to the appended drawings in which:

DESCRIPTION OF PREFERRED EMBODIMENTS

Figure 1:
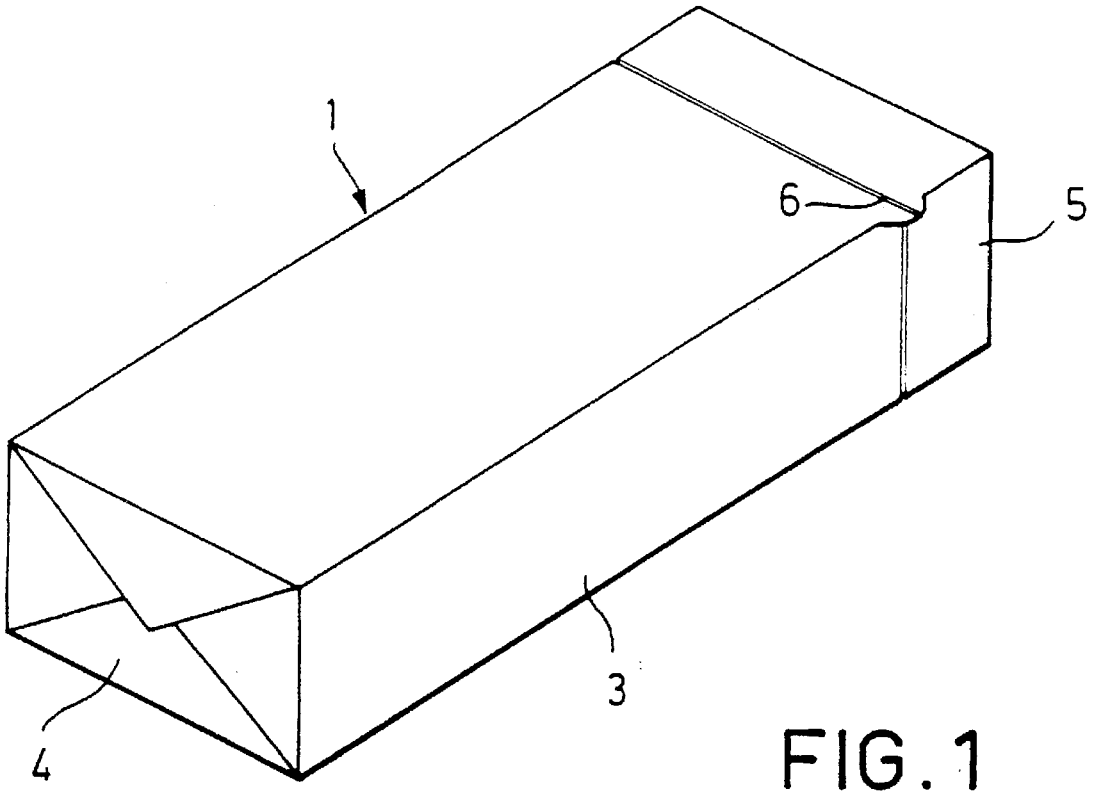
FIG. 1 is a perspective view of a package according to the invention, the wrapper of which is closed.

The package represented in FIGS. 1 to 4 comprises a pliant wrapper 1 which contains stacked elongate products 2.

The products 2 may be, for example, prepackaged ailments, such as strips of chewing gum, cheese slices, biscuits or bars of chocolate, or else other products, preferably prepackaged, such as chip cards.

The pliant wrapper 1 comprises a body 3 of cylindrical general shape having a rectangular base closed at its two ends, one constituting the end wall 4 and the other constituting the lid 5, by folding and adhesively bonding the ends of the body 3 to themselves. The body 3 also includes a tear strip 6 over its circumference, in proximity to the lid 5.

Figure 2:
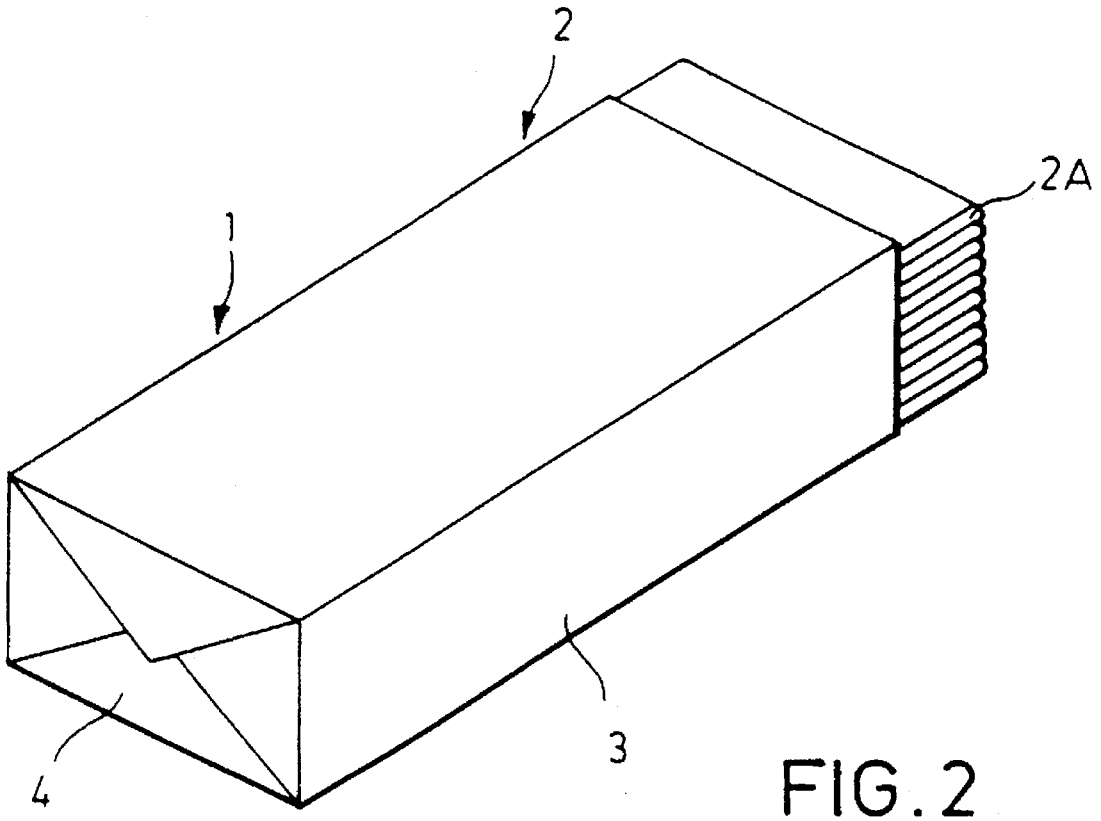
FIG. 2 is a perspective view of this package full and with its wrapper opened.

In order to consume the products, the wrapper 1 is opened by tearing the strip 6 along the circumference of the body 3 and removing the lid 5 and an adjoining portion of the body 3. This operation exposes one of the ends 2A of the products 2 contained by the wrapper, as represented in FIG. 2. The wrapper 1 thus opened can no longer be closed again.

Figure 3:
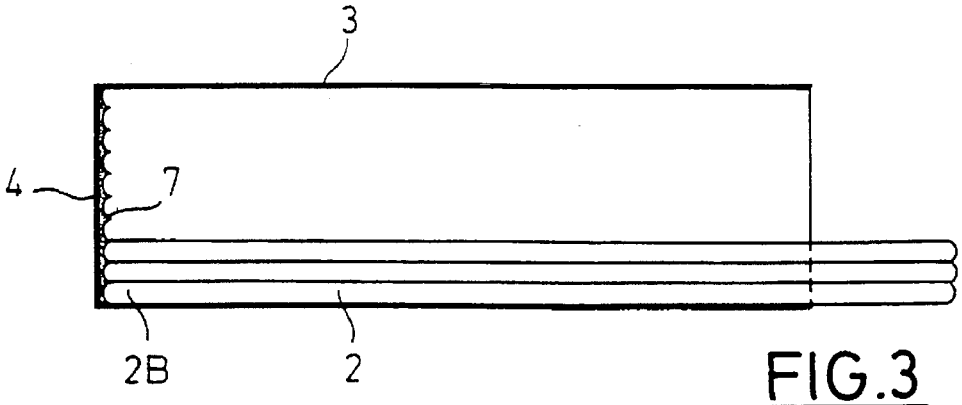
FIG. 3 is a longitudinal sectional view of the same package after taking out part of the products.
Figure 4:
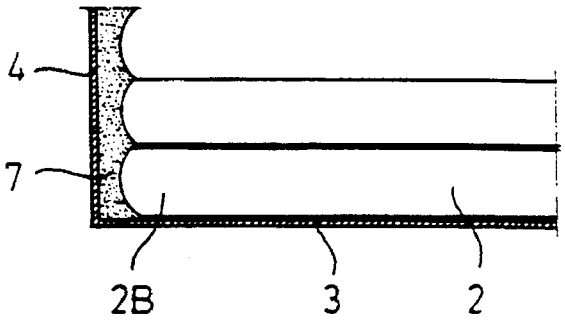
FIG. 4 is a partial view on an enlarged scale, in longitudinal section in proximity to the end wall of the wrapper of the package.

As indicated in FIG. 3, the package also includes a means of temporary adhesion, in this case a film of adhesive 7 having a low bond ability, applied to the end wall 4 of the wrapper 1, which connects, in a separable manner, this end wall 4 to the adjacent end 2B of each product 2 contained in the wrapper. The adhesive may, for example, be of the weak hot-melt type.

Thus, when the wrapper 1 is opened, the products 2 remain fastened to the open wrapper 1 because they are retained by their ends 2B against the end wall 4 of the wrapper by the film of adhesive 7. Despite the opening of the wrapper being non-reversible, the products contained therefore cannot be dispersed outside it. In order to consume the products contained in the open wrapper, all that it is required to do is to extract each product from the wrapper by pulling hard enough to release its end 2B from the end wall 4. The package thus preserves all its properties of Joining and of protecting the products.

A method of manufacturing the package 1 will now be described, with regard to FIGS. 5 to 8.

Figure 5:
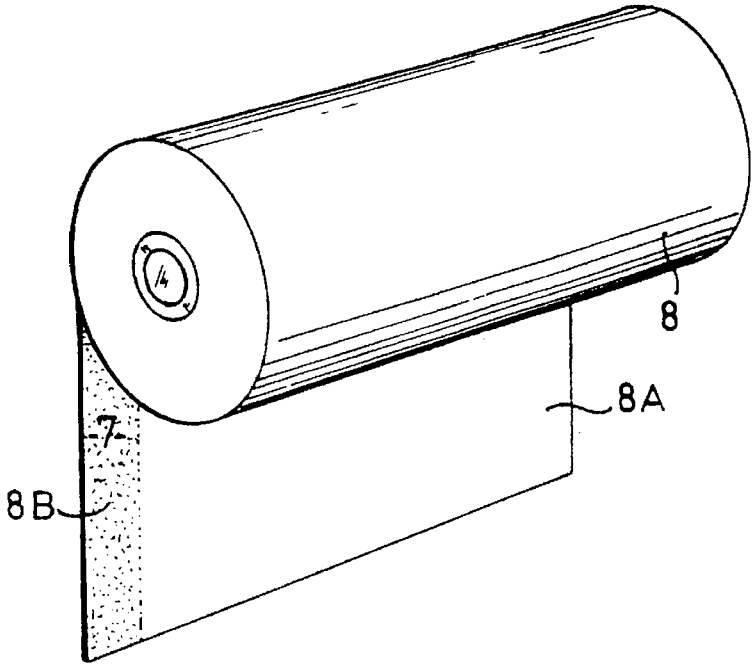
FIGS. 5 to 8 illustrate steps of a method of manufacturing such a package.
Figure 6:
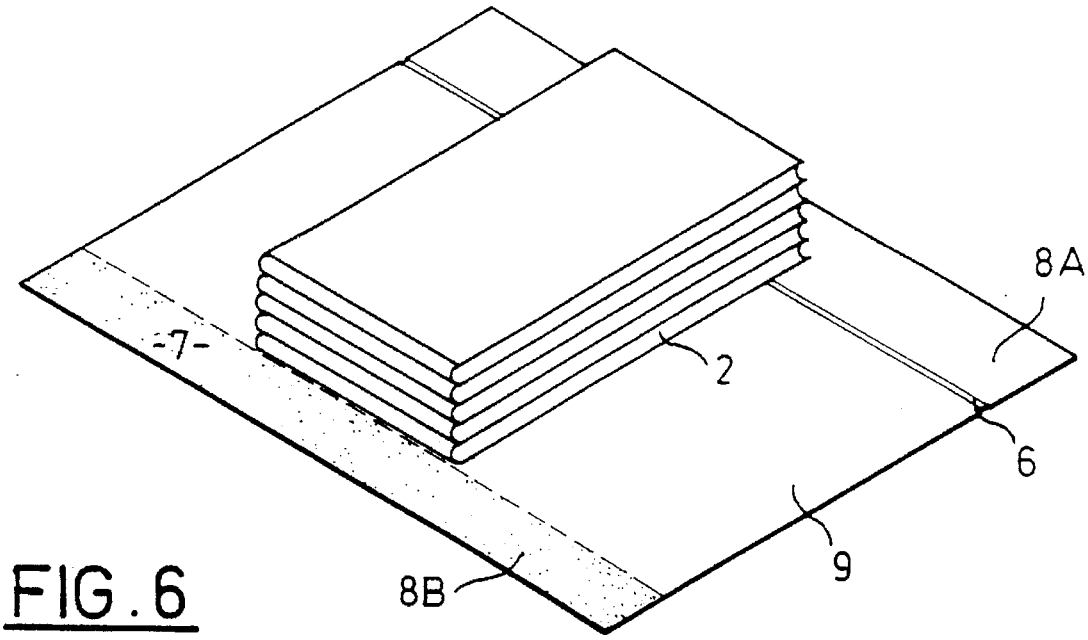

Starting from a roll of a strip 8 adhesively precoated continuously with the adhesive 7 on its inside face along a marginal area 8B, shown in FIG. 5, a tear strip 6 is fixed in proximity to the edge 8A opposite the area 8B, then sheets 9 are cut, on the inside face of each of which is deposited, beyond the adhesively precoated area, a stack of products 2, as shown in FIG. 6. The strip 8 also carries on its outside face adhesively precoated areas (not shown) serving to close the package in a conventional manner. For these areas, a (permanent) heat-activable adhesive, for example, is used.

The strip 8 may be made of paper or of a complex material, for example consisting of a plastic film, a film of printed paper and an aluminium film, these being superposed and adhesively bonded together. The width of the strip 8 is greater than the length of the products to be packaged.

Figure 7:
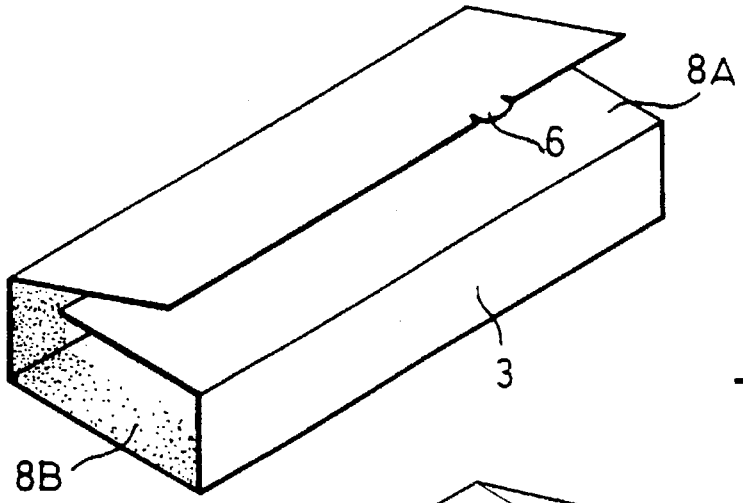
Figure 8:
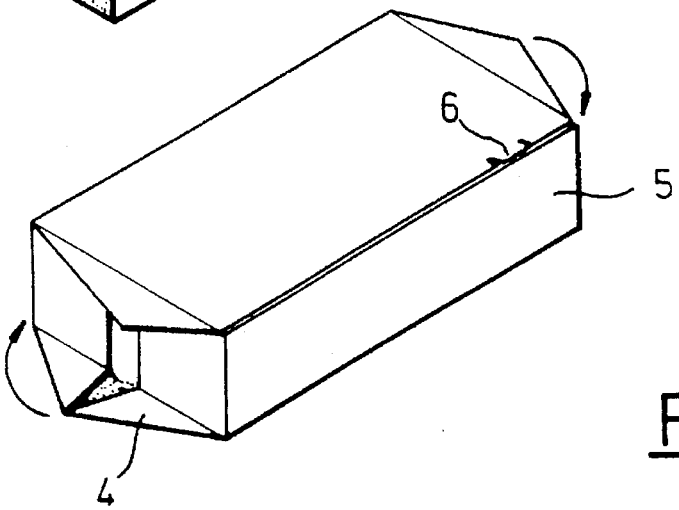

Next, the sheet 9 is folded into a tubular blank of the body 3, as indicated in FIG. 7, and the cut edges of the sheet are adhesively bonded to each other, an action which closes the blank along a generatrix; next, the marginal areas 8A and 8B of the sheet are folded over on themselves, these marginal areas now constituting the ends of the cylindrical body 3, respectively the lid 5 and the end wall 4 as indicated in FIG. 8. While this folding is taking place, the adhesively coated area 8B comes into contact with the corresponding end 2B of each of the products 2.

Next, the strong heat-activable adhesive and a film of weak (temporary) heat-activable adhesive of the sheet edge 8B are simultaneously activated by means of a device, not shown, for dissipating heat at both ends of the wrapper; this simultaneously causes the two ends of the wrapper to be sealed and the ends 2B of the products to adhere temporarily to the end wall 4 of the wrapper.

A variant of the same method consists in using, for the inside coating, at 8B, of the strip 8, a pressure-activable cold-setting adhesive. Pressing the wrapper 1 by both its ends, which accompanies the aforementioned sealing, then simultaneously ensures activation of the film of cold-setting adhesive of the sheet edge 8B and causes the temporary adhesion of the ends 2B of the products to the end wall 4 of the wrapper.

As a variant, the precoating with adhesive of the strip 8, by means of a weakly adhering adhesive, may be carried out in a different manner. Thus, the coating may be performed discontinuously, interrupting the adhesive coating of the area 8B at predetermined intervals or by adhesive coating only preindicated places in this area 8B which will constitute the end wall of the wrapper after folding. In this case, the adhesive coating may, on some packaging lines, be carried out in strips transverse to the direction of advance of the sheets 9. The coating may also be carried out along the entire length of the area 8B, but in the form of several parallel lines, possibly dotted lines, or with a repeated pattern such as mutually parallel oblique lines.

Also as a variant, it is possible to replace the strip 7 by prior adhesive coating, using the same type of weak adhesive, of the adjacent end 2B of the products 2.

As a further variant, the temporary adhesion of the products 2 to the end wall of the wrapper may be achieved by interposing a double-sided adhesive element.

What is claimed is:

1. A package for a series of products (2) which comprises a pliant wrapper (3) including a folded and sealed sheet, wherein a means (7) of weak adhesion of the products to be packaged is interposed between the wrapper (3) and each of the products in a region of the products that is aligned with a sealed area of the wrapper (3), said sealed area being sealed with strong adhesion means.

2. The package according to claim 1, wherein the pliant wrapper (3) includes first and second opposite ends, said first end being open or adapted to be closed by a lid (5), said second end being closed by folding and sealing and serving as an end wall (4) for the wrapper; and wherein the means of weak adhesion (7) of the products to be packaged is interposed between the end wall (4) of the wrapper and an adjacent end of each of the products.

3. Package according to claim 1, characterized in that it contains several stacked products (2) of elongate shape.

4. Package according to claim 1, characterized in that the means of adhesion (7) is carried by the wrapper (3).

5. Package according to claim 1, characterized in that each of the products carries the means of weak adhesion (7) which adheres to the wrapper (3).

6. Package according to claim 1, characterized in that the means of weak adhesion (7) comprises an adhesive of the pressure-activable cold-setting adhesive type.

7. Package according to claim 1, characterized in that the means of weak adhesion (7) comprises an adhesive of the heat-activable type.

8. A method of packaging products (2) of elongate shape, comprising producing a wrapper blank (3) of elongate general shape, filling the wrapper blank with the products, and forming a wrapper (3) of tubular general shape by folding and sealing by strong adhesive bonding, said method further comprising the steps of:

coating part of each of the products (2), which part is intended to come into contact with the wrapper via a means of temporary, weak adhesion (7); and activating the means of temporary, weak adhesion (7) at the same time as the sealing of the wrapper (3).

9. The method of packaging according to claim 8, in which the forming of the wrapper (3) includes a step of folding and sealing, by the adhesive bonding, at least one end of the wrapper blank, thus closing at least one end wall (4) of the wrapper (3), characterized in that each of the products (2) is coated on one of its ends, facing the end wall (4), by a means of the temporary, weak adhesion (7), and in that the means of adhesion (7) is activated at the same time as the sealing of the end wall (4) of the wrapper (3).

* * * * *